US007980547B2

(12) United States Patent
Ito et al.

(10) Patent No.: US 7,980,547 B2
(45) Date of Patent: Jul. 19, 2011

(54) SHEET SUPPLYING DEVICES AND IMAGE RECORDING APPARATUSES INCLUDING THE SAME

(75) Inventors: Shingo Ito, Kasugai (JP); Noritsugu Ito, Tokoname (JP); Naokazu Tanahashi, Nagoya (JP); Wataru Sugiyama, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/032,787

(22) Filed: Feb. 18, 2008

(65) Prior Publication Data

US 2008/0203650 A1 Aug. 28, 2008

(30) Foreign Application Priority Data

Feb. 28, 2007 (JP) ..... 2007-049614

(51) Int. Cl.
*B65H 3/44* (2006.01)

(52) U.S. Cl. ..... 271/9.11; 271/9.04; 271/9.01; 271/117

(58) Field of Classification Search ..... 271/9.01, 271/9.02, 9.04, 9.07, 9.11, 9.13, 9.12, 117, 271/118

See application file for complete search history.

(56) References Cited

U.S. PATENT DOCUMENTS

| | | | | |
|---|---|---|---|---|
| 4,577,849 | A * | 3/1986 | Watanabe | 271/9.02 |
| 6,032,942 | A * | 3/2000 | Cho | 271/9.11 |
| 6,135,438 | A * | 10/2000 | Newman et al. | 271/9.07 |
| 6,349,193 | B1 * | 2/2002 | Matayoshi | 399/388 |
| 6,688,590 | B2 * | 2/2004 | Billings et al. | 271/9.05 |
| 2006/0261535 | A1 * | 11/2006 | Shiohara et al. | 271/9.01 |

FOREIGN PATENT DOCUMENTS

| | | | |
|---|---|---|---|
| JP | S61-033437 | A | 2/1986 |
| JP | S61-037638 | A | 2/1986 |
| JP | S63-189339 | A | 8/1988 |
| JP | H05-270671 | A | 10/1993 |
| JP | H06-183586 | A | 7/1994 |
| JP | H08-040583 | A | 1/1996 |
| JP | H09-030673 | A | 2/1997 |
| JP | 2002-046874 | A | 2/2002 |
| JP | 2002-338070 | A | 11/2002 |
| JP | 2002338080 | A * | 11/2002 |

OTHER PUBLICATIONS

Japan Patent Office; Notice of Reasons for Rejection for Patent Application No. JP2007-049614, mailed Nov. 2, 2010. (counterpart to above-captioned U.S. patent application).

* cited by examiner

*Primary Examiner* — Stefanos Karmis
*Assistant Examiner* — Ernesto Suarez
(74) *Attorney, Agent, or Firm* — Baker Botts L.L.P.

(57) ABSTRACT

The invention describes an image recording device having a sheet supplying device that supplies sheets. The sheet supplying device has a first tray and a second tray that hold sheets, and a first and second shaft positioned over the first and second trays. A first rotating member contacts a sheet in the first tray, and a second rotating member contacts a sheet in the second tray. A first arm extends from the first shaft to the first rotating member, and a second arm extends from the second shaft to the second rotating member. A transmission device is coupled to the first arm member and the second arm member, and transmits selectively a rotational drive force from the first shaft to either the first or second rotating members. A recording unit records an image on the sheet supplied by the sheet supplying device.

23 Claims, 6 Drawing Sheets

SHEET SUPPLYING DEVICES AND IMAGE RECORDING APPARATUSES INCLUDING THE SAME

CROSS REFERENCE TO RELATED APPLICATION

The present application claims priority from Japanese Patent Application No. 2007-049614, filed on Feb. 28, 2007, the disclosure of which is incorporated herein by reference in its entirety.

BACKGROUND OF THE INVENTION

1. Field of the Invention

The present invention relates to sheet supplying devices configured to feed sheet members held in each of a plurality of sheet trays in a predetermined direction and image recording apparatuses including the sheet supplying devices.

2. Description of Related Art

Image recording apparatuses, such as printers, mount sheet supplying devices thereon. A sheet supplying device includes a sheet tray configured to hold a stack of recording sheets. A sheet supplying device further includes a feed roller configured to feed recording sheets stacked in a sheet tray while separating the recording sheets. The feed roller rotates while contacting an upper surface of a stack of recording sheets in the sheet tray, to feed a recording sheet from the sheet tray.

Known paper feeding devices may have two sheet trays that are arranged vertically in a stepped manner. Feed rollers are provided for each of two sheet trays. In known image recording apparatuses, upper and lower sheet trays are positioned below the drive shaft. A transmission mechanism is configured to transmit rotation of the drive shaft in one direction to the upper tray feed rollers. The transmission mechanism also is configured to transmit rotation of the drive shaft in an opposite direction to the lower tray feed rollers positioned near each end of the drive shaft. In the transmission mechanism, the rotating shaft is positioned above the drive shaft, and transmission gears are mounted to the rotating shaft, which increase the size of the transmission mechanism in the vertical direction. In other known transmission mechanism and sheet tray arrangements, a path must be maintained to feed a recording sheet below and above the drive shaft, which path increases the size of the paper feeding device.

SUMMARY OF THE INVENTION

In an embodiment of the invention, a sheet supplying device configured to supply a sheet member, the sheet supplying device comprising a first tray and a second tray, each configured to hold at least one sheet member, a first shaft and a second shaft, each positioned over both of the first tray and the second tray, a first rotating member contacting the at least one sheet member held in the first tray, a second rotating member contacting the at least one sheet member held in the second tray, a first arm member extending from the first shaft to the first rotating member, a second arm member extending from the second shaft to the second rotating member, and a transmission device coupled to each of the first arm member and the second arm member and configured to transmit selectively a rotational drive force from the first shaft to one of the first rotating member and the second rotating member.

In an embodiment of the invention, an image recording apparatus comprises a sheet supplying device configured to supply a sheet member, the sheet supplying device comprising a first tray and a second tray, each configured to hold at least one sheet member, a first shaft and a second shaft, each positioned over both of the first tray and the second tray, a first rotating member contacting the at least one sheet member held in the first tray, a second rotating member contacting the at least one sheet member held in the second tray, a first arm member extending from the first shaft to the first rotating member, a second arm member extending from the second shaft to the second rotating member, and a transmission device coupled to each of the first arm member and the second arm member and configured to transmit selectively a rotational drive force from the first shaft to one of the first rotating member and the second rotating member, and a recording unit configured to record an image on the sheet member supplied by the sheet supplying device.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF PREFERRED EMBODIMENTS

An embodiment of the invention and its features and technical advantages may be understood by referring to FIGS. 1-6, like numerals being used for like corresponding portions in the various drawings.

Figure 1:
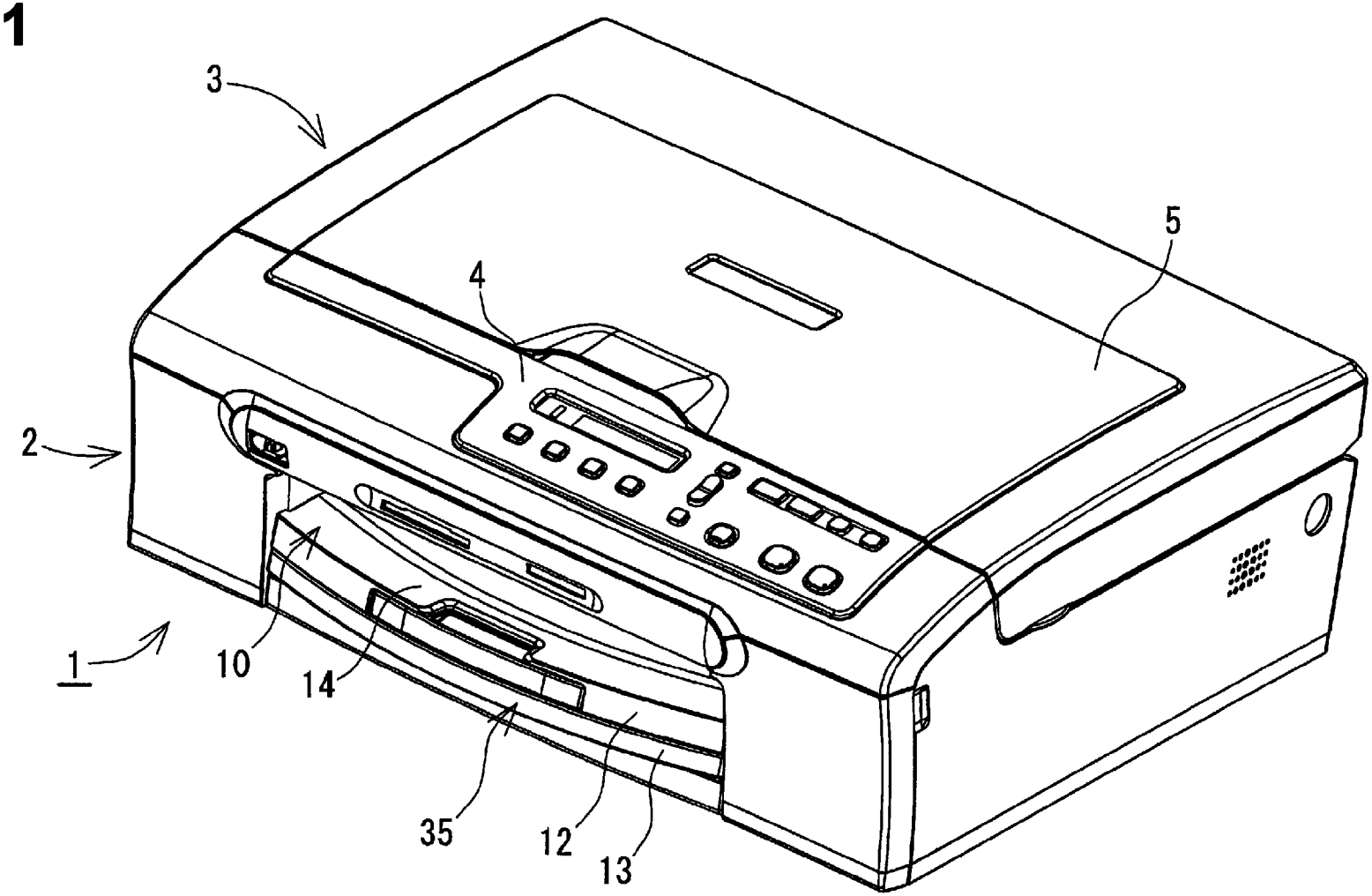
FIG. 1 is a perspective view of a multi-function device (MFD), according to an embodiment of the invention.

Referring to FIG. 1, a multi-function device ("MFD") 1 may comprise a printer section 2 and a scanner section 3. MFD 1 may have a printing function, a scanner function, a copying function and a facsimile function. MFD 1 may have a hexahedron shape, the width and depth of which may be greater than its height. An upper portion of MFD 1 may include a scanner section 3, which may be configured as a flat bed scanner. As shown in FIG. 1, MFD 1 may include a document cover 5 as a top panel. Document cover 5 may pivot about a hinge (not shown) positioned at a rear side of scanner section 3. A platen glass and an image sensor (not shown) may be positioned under document cover 5. An image on a document placed on the platen glass may be read by the image sensor.

Figure 2:
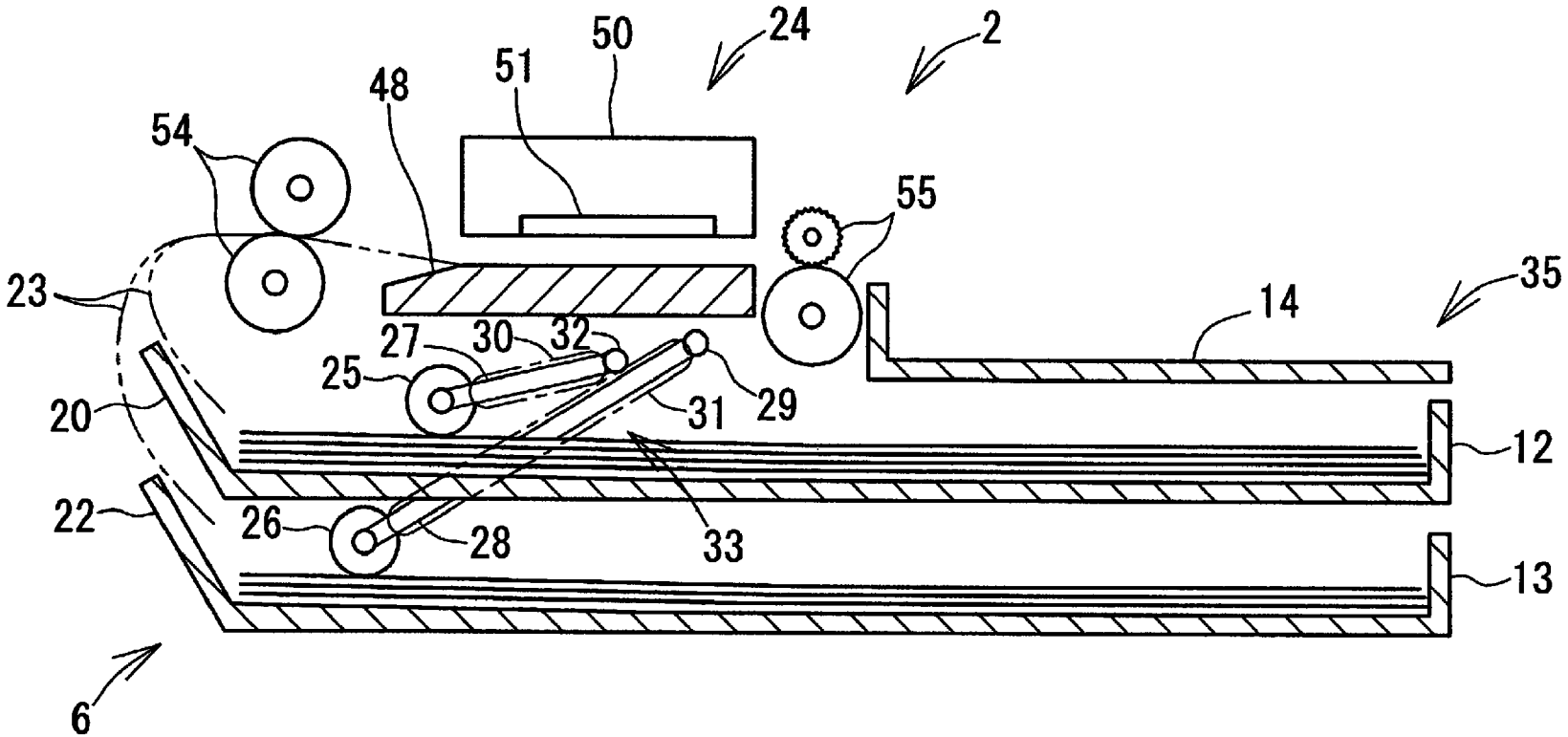
FIG. 2 is a cross-sectional view of a printer section of the MFD showing an inner structure of the printer section, according to an embodiment of the invention.

MFD 1 may include a printer section 2 at its lower portion. Printer section 2 may record an image or text, or both, on a recording sheet, as an example of a sheet member, based on print data, e.g., image data or text data input from an external device, and image data read by scanner section 3. Printer section 2 may have an opening 10 at a front face of MFD 1. As shown in FIGS. 1 and 2, an upper sheet tray 12, a lower sheet tray 13, and an output tray 14 may be positioned vertically in opening 10. Trays 12, 13, 14 may be assembled into a sheet cassette 35.

Each of upper and lower sheet trays 12, 13 may hold a stack of recording sheets. Upper sheet tray 12 and lower sheet tray 13 may be configured to hold different sizes or weights of sheets. Specifically, upper sheet tray 12 may hold recording sheets with the size of, e.g., postcards, standard photos, and business cards. Lower sheet tray 13 may hold recording sheets with a size of B5 or larger, e.g., A4 and letter sizes. Lower sheet tray 13 may be configured to be unable to hold recording sheets, such as postcards, smaller than B5 sizes. The sheet size held by lower sheet tray 13 also may be determined based on whether a first sheet feeding mechanism 33A is configured to feed recording sheets from lower sheet tray 13. More specifically, if first sheet feeding mechanism 33A is not configured to feed recording sheets from lower sheet tray 13, the size of such recording sheets may not be held even though the recording sheets could be held in lower sheet tray 13.

When an image, or text, or both, is recorded in printer section 2 on a recording sheet fed from upper or lower sheet tray 12, 13, the sheet may be ejected onto output tray 14. Printer section 2 and scanner section 3 may execute instructions input from a control panel 4 positioned on an upper front portion of MFD 1 or instructions transmitted from a computer via a printer driver or a scanner driver.

Referring to FIGS. 2 to 4B, printer section 2 may comprise a sheet feeder 6, including sheet cassette 35 and a sheet feeding mechanism 33. Sheet cassette 35 may hold a plurality of types of recording sheets. Sheet cassette 35 may comprise upper sheet tray 12, lower sheet tray 13, and output tray 14. Sheet feeding mechanism 33 may be configured to selectively feed recording sheets held in upper sheet tray 12 or lower sheet tray 13. As shown in FIG. 2, upper sheet tray 12 may be positioned above lower sheet tray 13. In other words, upper sheet tray 12 and lower sheet tray 13 may be stacked in the vertical direction. A first feed roller 26 may be positioned at an upper side of lower sheet tray 13. A second feed roller 25 may be positioned at an upper side of upper sheet tray 12. Upper sheet tray 12 may be formed of synthetic resin. As shown in FIGS. 3A and 3B, a pair of sheet guides 37 and a rear guide 38 may be positioned on an upper surface of upper sheet tray 12.

Sheet guides 37 may be configured to align edges of recording sheets, which are loaded on upper sheet tray 12, in a width, e.g., lateral, direction of the recording sheets. Sheet guides 37 may be positioned on an upper surface of upper sheet tray 12 at a downstream side in the sheet feeding direction, e.g., the direction of arrow 43, at a side closer to an inclined plate 20. Sheet guides 37 may slidably move on an upper surface of upper sheet tray 12 along a width, e.g., lateral, direction of upper sheet tray 12. Recording sheets may be positioned between sheet guides 37. Positions of recording sheets, which are loaded onto upper sheet tray 12, may be regulated by a pair of sheet guides 37, with respect to their width, e.g., lateral, direction. More specifically, sheet guides 37 may regulate the positions of recording sheets loaded onto upper sheet tray 12 so as to substantially align a center of the recording sheets with respect to their width, e.g., lateral, direction, with a predetermined reference position. The center of upper sheet tray 12 in its width, e.g., lateral, direction may be set as the reference position.

A pair of sheet guides 37 may be coupled to each other by a known coupling mechanism, such as a rack and pinion mechanism. As one of sheet guides 37 may be slidably moved in one direction, the other sheet guide 37 may be slidably moved in an opposite direction.

Rear guide 38 may be configured to align rear or trailing ends of recording sheets loaded onto upper sheet tray 12. Rear guide 38 may be supported at an upper surface of upper sheet tray 12 so as to slide in the sheet feeding direction, e.g., the direction of arrow 43. Rear guide 38 may be configured to stop at positions corresponding to predetermined sheet sizes, e.g., the sizes of postcards, photographs, and business cards.

A friction pad 41 may be positioned between sheet guides 37 at generally a middle portion of upper sheet tray 12 in its width, e.g., lateral, direction. Friction pad 41 may be positioned on an upper surface of upper sheet tray 12 at a position to contact second feed roller 25. Friction pad 41 may be formed of material having a high friction coefficient, such as cork and felt. Second feed roller 25 may contact directly friction pad 41 or indirectly contact friction pad 41 via recording sheets. With friction pad 41, when second feed roller 25 rotates, for example, with a reduced amount of remaining recording sheets in upper sheet tray 12, frictional force in the sheet feeding direction, e.g., the direction of arrow 43, may be applied from second feed roller 25 to an upper part of a stack of recording sheets and frictional force in the opposite direction may be applied from friction pad 41 to a lower part of a stack of recording sheets. Thus, a situation where a plurality of recording sheets is fed simultaneously may be reduced.

Figure 3A:
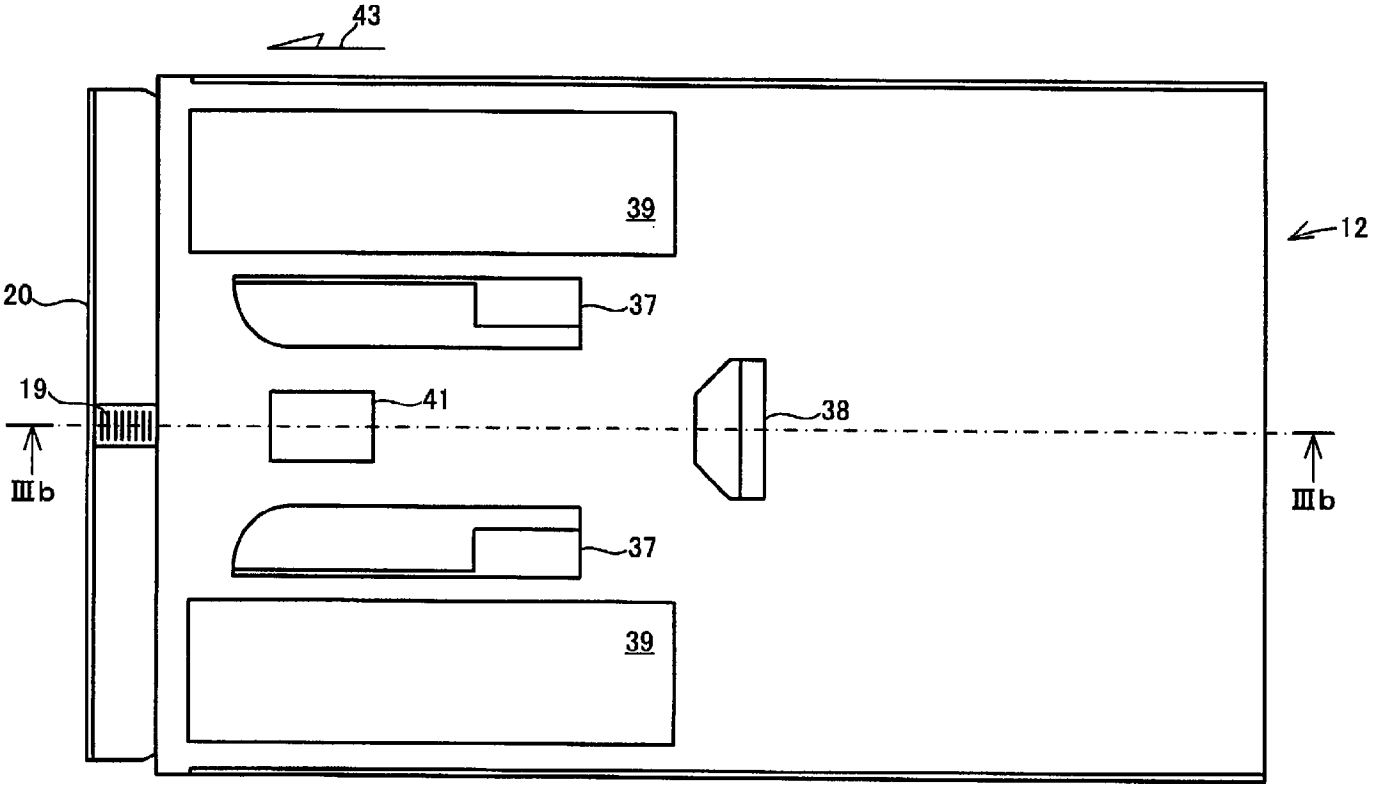
FIG. 3A is a plan view of an upper sheet tray, according to an embodiment of the invention.
Figure 3B:
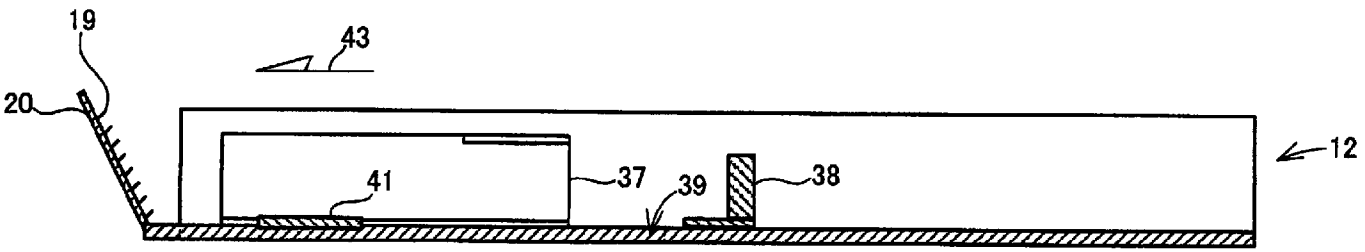
FIG. 3B is a cross-sectional view of the upper sheet tray taken along the line IIIb-IIIb of FIG. 3A.

Upper sheet tray 12 may have two openings 39. Each opening 39 may be positioned on an upper surface of upper sheet tray 12 at a downstream side in the sheet feeding direction. More specifically, openings 39 may be positioned near ends of upper sheet tray 12 in its width, e.g., lateral, direction and outside sheet guides 37. With such arrangements of openings 39, a slidable range of sheet guides 37 is limited to an area defined between openings 39. As shown in FIG. 3A, each opening 39 may be of a rectangular shape elongated in a longitudinal direction of upper sheet tray 12, e.g., a right and left direction as shown in FIG. 3A. Each opening 39 may pass through from an upper surface of upper sheet tray 12 to its lower surface. A swing arm 28 may insert into each opening 39 from an upper side to a lower side of upper sheet tray 12.

Figure 4A:
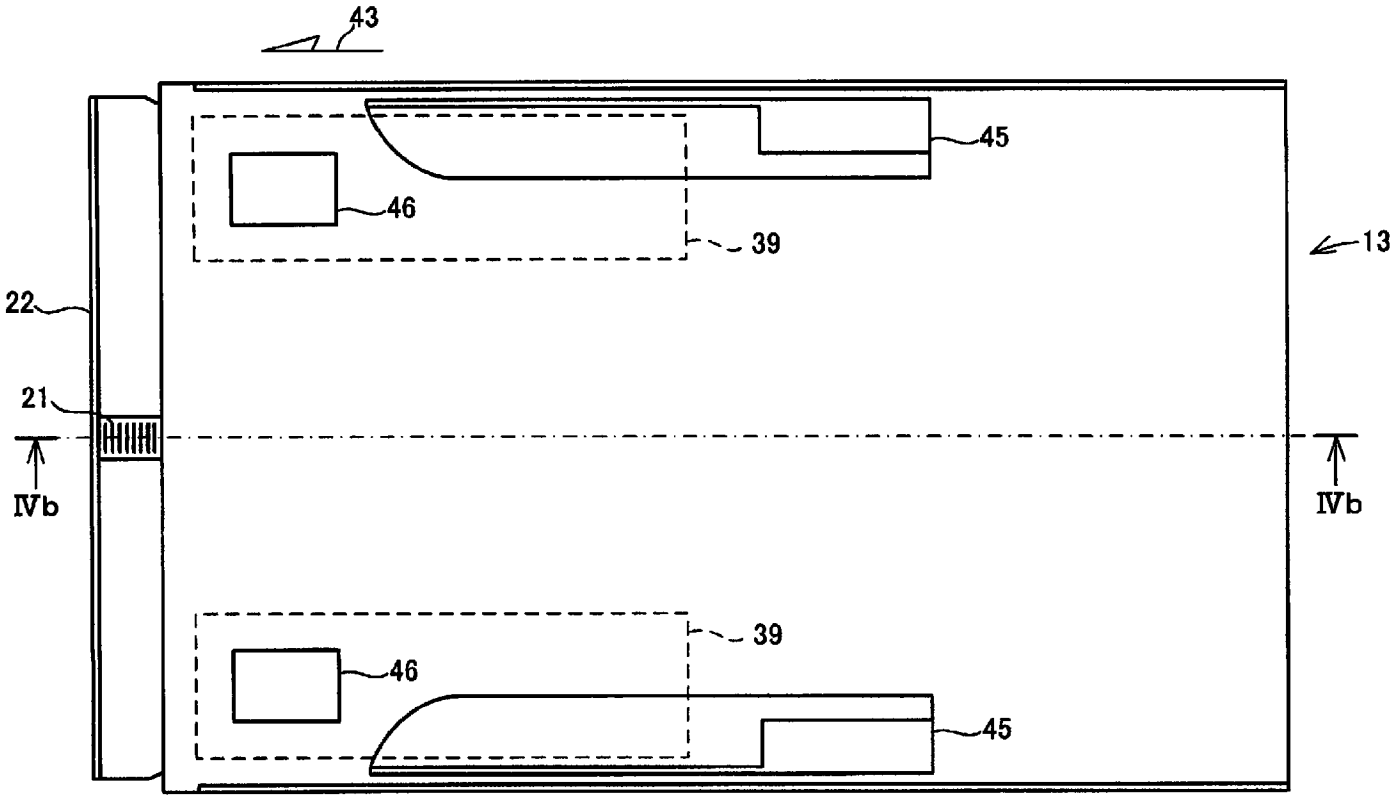
FIG. 4A is a plan view of a lower sheet tray, according to an embodiment of the invention.
Figure 4B:
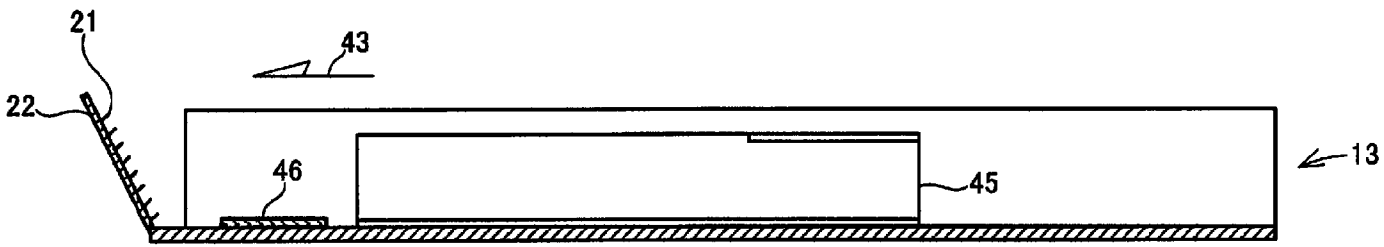
FIG. 4B is a cross-sectional view of the lower sheet tray taken along the line IVb-IVb of FIG. 4A.

As shown in FIGS. 4A and 4B, a pair of sheet guides 45 may be positioned on an upper surface of lower sheet tray 13. Sheet guides 45 may be supported at an upper surface of lower sheet tray 13 so as to slidably move in a width, e.g., lateral, direction of lower sheet tray 13. Recording sheets may be placed between sheet guides 45. Each sheet guide 45 may be positioned near an end of an upper surface of lower sheet tray 13 in its width, e.g., lateral, direction, so as to slidably move inwardly by a predetermined distance to a predetermined position. A coupling mechanism of sheet guides 45 is similar to that of sheet guide 37, and further description with respect to sheet guides 45 is omitted here.

Friction pads 46 configured similar to friction pad 41 may be positioned on an upper surface of lower sheet tray 13. Friction pads 46 may be positioned below openings 39 of upper sheet tray 12. Broken lines in FIGS. 4A and 4B show openings 39. Friction pads 46 may be positioned on an upper surface of lower sheet tray 13 at positions to contact first feed rollers 26. Because friction pads 46 are similar to friction pad 41, further description with respect to friction pads 46 is omitted here.

As shown in FIGS. 3A to 4B, inclined plates 20, 22 may be positioned in upper sheet tray 12 and lower sheet tray 13, respectively. Each inclined plate 20, 22 may be positioned at an angle such that its downstream end in the sheet feeding direction, e.g., the direction of arrow 43, inclines toward a rear side of MFD 1. An inner surface of each inclined plate 20, 22 may function as a guide surface to guide recording sheets to a sheet feeding path 23, as shown in FIG. 2. Each inclined plate 20, 22 may have a plurality of separation teeth 19, 21, respectively that extend from a middle portion of an inner surface of inclined plate 20, 22. Separation teeth 19, 21 may be disposed along the sheet feeding direction. When leading ends of a plurality of recording sheets, which are fed at one time from sheet tray 12, 13, contact inclined plates 20, 22, separation teeth 19, 21 may separate the recording sheets to guide a topmost recording sheet to sheet feeding path 23.

As shown in FIG. 2, sheet feeding path 23 may be positioned so as to extend upward from a rear side of sheet cassette 35, e.g., a downstream side of cassette 35 in the sheet feeding direction. As shown in FIG. 1, sheet feeding path 23 may extend upward from inclined plates 20, 22 and make a curve toward a side in which opening 10 is positioned. Thus, sheet feeding path 23 may extend from a rear side of MFD 1 to its front side, reaching output tray 14 via a recording unit 24. When a recording sheet fed from sheet tray 12 or 13 is conveyed to sheet feeding path 23, the sheet may be guided, so as to make a U-turn from a lower side to an upper side, to a platen 48. Recording unit 24 may perform an image recording onto the recording sheet. Then, the sheet may eject onto output tray 14.

Platen 48 may be positioned directly above sheet feeding mechanism 33. Platen 48 may have a supporting surface enough wide to support recording sheets in their width, e.g., lateral, direction. Recording unit 24 may be positioned above platen 48, and may comprise a carriage 50 and recording heads 51, which may be mounted on carriage 50. Recording heads 51 may be positioned according to the color of ink contained therein. A belt driving mechanism (not shown) may reciprocate carriage 50 at a predetermined interval, in a width, e.g., lateral, direction of platen 48, while being guided by a guide rail and a guide shaft (not shown).

Roller pairs 54, 55 may be positioned upstream and downstream of platen 48 in the sheet feeding direction. Each roller pair 54, 55 may comprise a roller that is driven by a motor and a pinch roller that is pressed against and driven by the roller. Roller pair 54 may nip, e.g., sandwich, a recording sheet fed along sheet feeding path 23, to convey the recording sheet onto platen 48. Roller pair 55 may hold the recording sheet having an image recorded thereon to convey the recording sheet to output tray 14. Roller pairs 54, 55 may be driven intermittently according to a predetermined amount of rotation. Thus, the recording sheet placed on platen 48 may be fed by predetermined amounts, while being stopped intermittently. While rotation of roller pairs 54, 55 is stopped, recording unit 24 may be reciprocated in a lateral direction of the recording sheet, and recording heads 51 may selectively eject color ink from their nozzles. A color image may be recorded onto the recording sheet, starting from its leading end and moving toward its trailing end. The recorded sheet may eject onto output tray 14.

Figure 5:
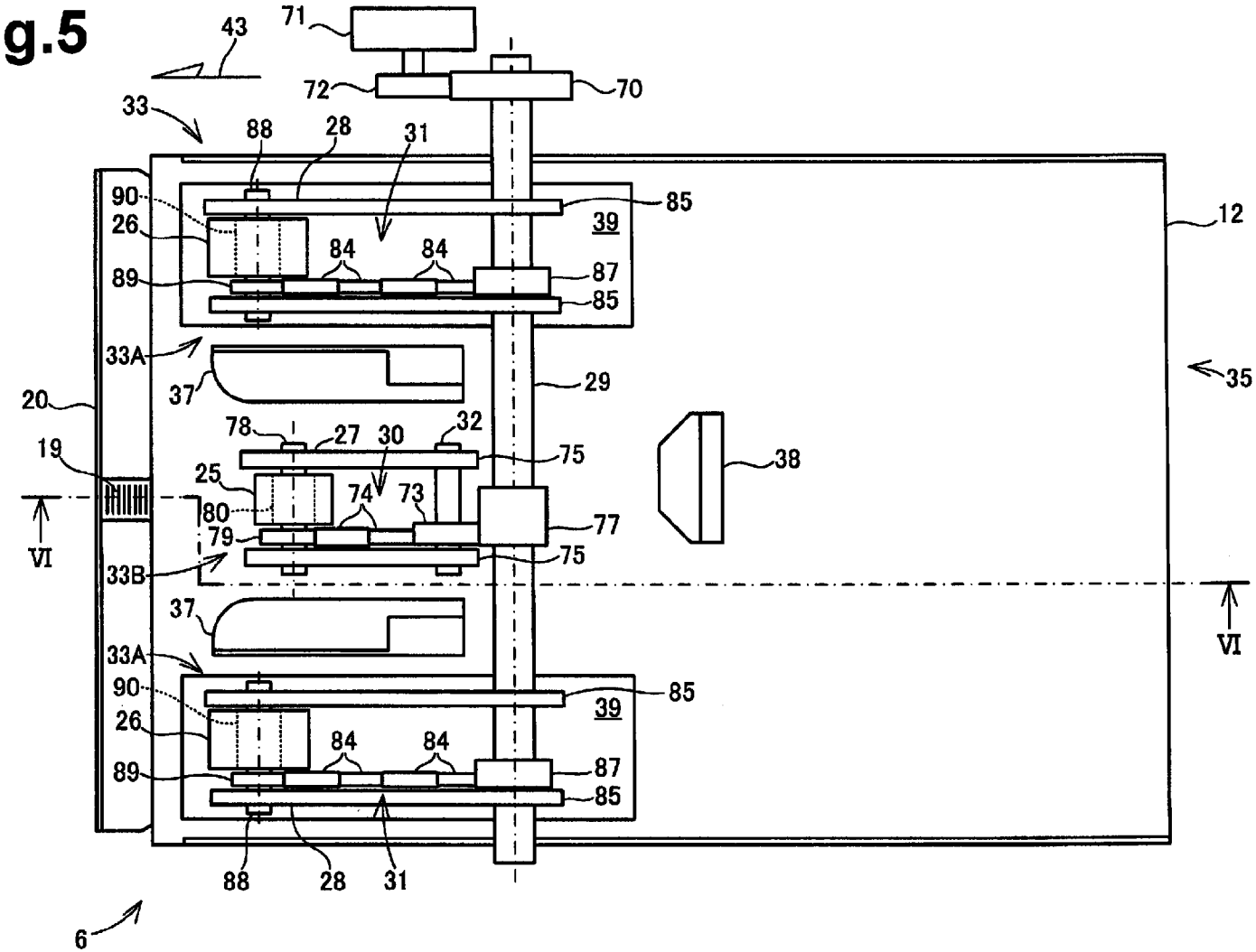
FIG. 5 is a plan view of a sheet feeder, according to an embodiment of the invention.
Figure 6:
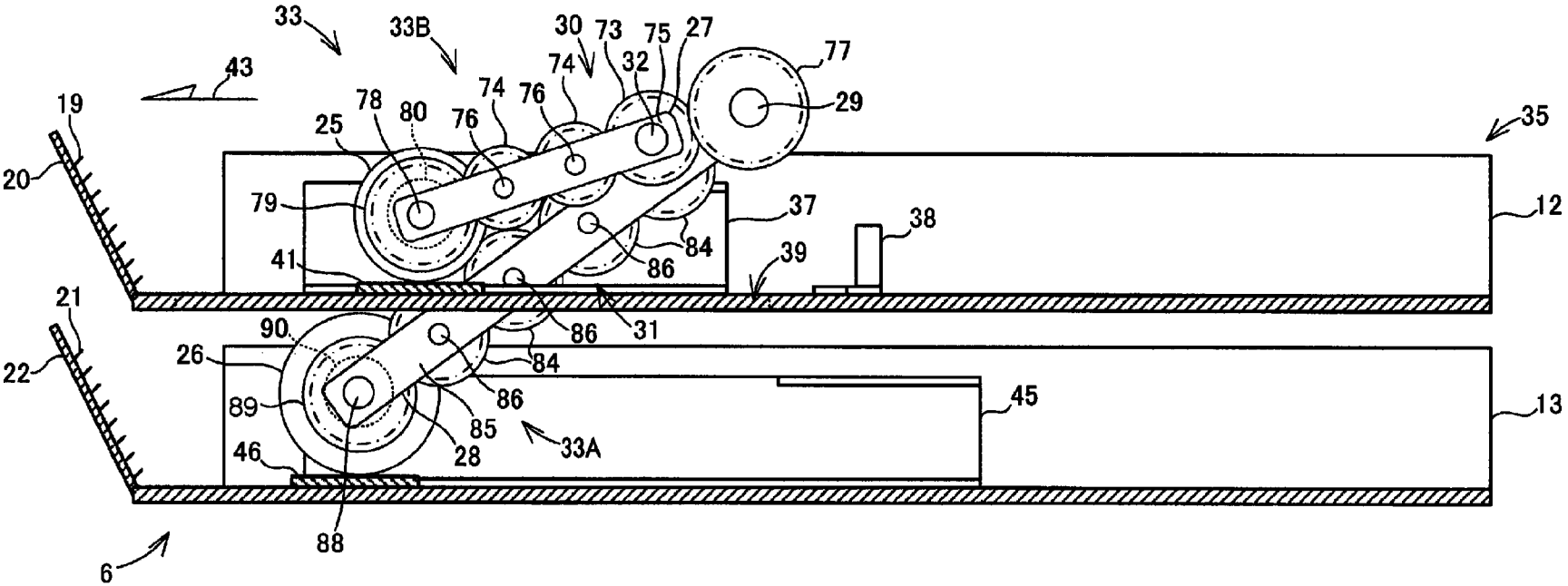
FIG. 6 is a cross-sectional view of the sheet feeder taken along the line VI-VI of FIG. 5.

For simplicity in illustration, output tray 14 is omitted in FIGS. 5 and 6. Sheet feeding mechanism 33 may comprise a second sheet feeding mechanism 33B configured to feed recording sheets held in upper sheet tray 12 and a first sheet feeding mechanism 33A configured to feed recording sheets held in lower sheet tray 13. First sheet feeding mechanism 33A may comprise first feed roller 26, a first swing arm 28, a drive force transmission mechanism 31, and a drive shaft 29. Second sheet feeding mechanism 33B may comprise second feed roller 25, a second swing arm 27, a drive force transmission mechanism 30, and a supporting shaft 32.

Referring to FIG. 2, shafts 29, 32 may be positioned above sheet cassette 35 and below platen 48. Drive shaft 29 may extend across MFD 1 in its width, e.g., lateral, direction, and may be supported rotatably by a body frame of MFD 1. As shown in FIG. 5, first sheet feeding mechanisms 33A may be connected to drive shaft 29 at a portion near each end of drive shaft 29. Supporting shaft 32 may be positioned parallel to drive shaft 29. Supporting shaft 32 may be supported rotatably by the body frame at a middle portion of MFD 1 in its width, e.g., lateral, direction. Second sheet feeding mechanism 33B may be connected to a generally a central portion of supporting shaft 32 in its axial direction. Second sheet feeding mechanism 33B may be positioned between first feeding mechanisms 33A.

A transmission gear 70 may be mounted on an end of drive shaft 29. Transmission gear 70 may engage a transmission gear 72, which may be connected directly to an output shaft of a motor 71. When motor 71 is driven, a drive force, e.g., rotational torque, from motor 71 may be transmitted to drive shaft 29 via transmission gears 72, 70 to rotate drive shaft 29 in a predetermined direction. Motor 71 may be configured to rotate clockwise or counterclockwise and may be controlled by a motor driver.

As shown in FIG. 5, with respect to second sheet feeding mechanism 33B, second swing arm 27 may comprise two plate members 75 formed of a resin material. More specifically, second swing arm 27 may be configured such that plate members 75 face each other with a predetermined distance therebetween. An end of second swing arm 27 may be supported pivotably by supporting shaft 32. More specifically, supporting shaft 32 may support second swing arm 27 to position arm 27 at a substantially middle portion of upper sheet tray 12 in its lateral direction. With such a structure, second swing arm 27 may pivot about supporting shaft 32 at a substantially middle portion of upper sheet tray 12 in its width, e.g., lateral, direction.

As shown in FIG. 6, second swing arm 27 may extend from supporting shaft 32 toward a substantially middle portion of the upper surface of upper sheet tray 12 in its lateral direction. Second feed roller 25 may be supported rotatably at an end of second swing arm 27. More specifically, second feed roller 25 may be mounted, via a one-way clutch 80, to a shaft 78 that is supported rotatably at an end of second swing arm 27. Thus, second feed roller 25 may be positioned at a middle portion of the upper surface of upper sheet tray 12 in its width, e.g., lateral, direction. Second feed roller 25 may be positioned between plate members 75. A roller surface of second feed roller 25 may be covered with a rubber member to cause high friction when second feed roller 25 contacts a recording sheet.

Drive force transmission mechanism 30 may comprise transmission gears 77, 73, 79 and two intermediate gears 74. Transmission gear 77 may be fixed to drive shaft 29. When drive shaft 29 rotates, transmission gear 77 may rotate in the same direction as drive shaft 29. Transmission gear 73 may be fixed to supporting shaft 32 inside plate member 75. When transmission gear 73 rotates, supporting shaft 32 may rotate in the same direction as transmission gear 73. Transmission gear 73 may engage with transmission gear 77. As drive shaft 29 rotates, drive force in the direction opposite to the rotation of drive shaft 29 may be transmitted to transmission gear 73. Transmission gear 79 may be fixed to shaft 78 inside plate member 75. When transmission gear 79 rotates, shaft 78 may rotate in the same direction as transmission gear 79. Two intermediate gears 74 may be positioned between transmission gears 79, 73. As shown in FIG. 6, each intermediate gear 74 may be supported rotatably by a shaft 76 that may be positioned on plate member 75. A gear train from transmission gear 77 to transmission gear 79, including transmission gear 73 and intermediate gears 74, may be positioned along second swing arm 27. Drive force input to drive shaft 29 may be transmitted to shaft 78 of second feed roller 25 via transmission gears 77, 73, intermediate gears 74 and transmission gear 79.

Drive force transmission mechanism 30 may be configured to transmit drive force from drive shaft 29 to shaft 78 of second feed roller 25 via a plurality of, e.g., five, gears. Drive force in the same direction as the rotating direction of drive shaft 29, e.g., drive force in the direction opposite to the rotating direction of supporting shaft 32, may be transmitted to shaft 78 of second feed roller 25. Shaft 78 may be rotated in the same direction as the rotating direction of drive shaft 29 and in the opposite direction to the rotating direction of supporting shaft 32.

Drive force transmission mechanism 30 may comprise a one-way clutch 80. One-way clutch 80 may be fitted into an inner hole of second feed roller 25. One-way clutch 80 may be configured to transmit drive force to second feed roller 25 when the drive force to feed a recording sheet in the sheet feeding direction, e.g., the direction indicated by arrow 43, is transmitted to shaft 78. One-way clutch 80 also may be configured to slip, e.g., not transmit drive force, to second feed roller 25 when the drive force to feed a recording sheet in a direction opposite to the sheet feeding direction is transmitted to shaft 78. As shown in FIG. 6, when drive shaft 29 is rotated in the clockwise direction, drive force transmitted from drive shaft 29 to shaft 78 may be transmitted to second feed roller 25 via one-way clutch 80. At this time, transmission gear 73 may rotate in a counterclockwise direction, such that second swing arm 27 supported pivotably by supporting shaft 32 may be urged in a direction approaching a bottom plate of upper sheet tray 12. When drive shaft 29 is rotated in the counterclockwise direction, drive force in the counterclockwise direction transmitted to shaft 78 via gears from drive shaft 29 may be interrupted by one-way clutch 80. Therefore, the drive force may not be transmitted to second feed roller 25. At this time, transmission gear 73 may rotate clockwise, so that second swing arm 27 supported pivotably by supporting shaft 32 may be urged in a direction away from the bottom plate of upper sheet tray 12. In this case, recording sheets in upper sheet tray 12 may not be fed but held in tray 12.

Second swing arm 27 may be urged in a direction approaching the bottom plate of upper sheet tray 12 by a force of its own weight, a force of the weights of second feed roller 25 and drive force transmission mechanism 30, and a force of a spring (not shown). When the roller surface of second feed roller 25 contacts a recording sheet in upper sheet tray 12, second swing arm 27 may stop. As drive force in the direction of feeding a recording sheet, e.g., the direction of arrow 43 is transmitted to second feed roller 25 with second swing arm 27 stopped, friction force may be generated between the roller surface of second feed roller 25 and a recording sheet, and the recording sheet may be fed in the sheet feeding direction. In other words, friction force may be applied to a recording sheet as a feeding force to feed the recording sheet in the sheet feeding direction.

As shown in FIG. 5, with respect to first sheet feeding mechanism 33A, each first swing arm 28 may comprise two plate members 85 formed of a resin material. More specifically, first swing arm 28 may be configured such that plate members 85 face each other with a predetermined distance therebetween. An end of each first swing arm 28 may be supported pivotably by drive shaft 29. More specifically, drive shaft 29 may support each first swing arm 28 to position each arm 28 near an end of lower sheet tray 13 in its width, e.g., lateral, direction.

As shown in FIG. 6, each first swing arm 28 may extend from drive shaft 29 toward the upper surface of lower sheet tray 13 through relevant opening 39 of upper sheet tray 12. Each first swing arm 28 may pivot about drive shaft 29 at a position near an end of lower sheet tray 13 in its width, e.g., lateral, direction. First feed roller 26 may be supported rotatably at an end of each first swing arm 28. More specifically, each first feed roller 26 may be mounted, via a one-way clutch 90, to a shaft 88 that is supported rotatably at an end of first swing arm 28. Thus, each first feed roller 26 may be positioned on the upper surface of lower sheet tray 13 near an end in its width, e.g., lateral, direction. Each first feed roller 26 may be positioned between plate members 85. A roller surface of first feed roller 26 may be covered with a rubber member to cause high friction when first feed roller 26 contacts a recording sheet.

Drive force transmission mechanism 31 may comprise transmission gears 87, 89 and four intermediate gears 84. Transmission gear 87 may be fixed to drive shaft 29 inside plate member 85. When drive shaft 29 rotates, transmission gear 87 may rotate in the same direction as drive shaft 29. Transmission gear 89 may be fixed to shaft 88 inside plate member 85. When shaft 88 rotates, transmission gear 89 may rotate in the same direction as shaft 88. Four intermediate gears 84 may be positioned between transmission gears 87, 89. As shown in FIG. 6, each intermediate gear 84 may be supported rotatably by a shaft 86 that may be positioned on plate member 85. A gear train from transmission gear 87 to transmission gear 89 via intermediate gears 84 may be positioned along first swing arm 28. Drive force input to drive shaft 29 may be transmitted to shaft 88 of first feed roller 26, via transmission gear 87, intermediate gears 84 and transmission gear 89.

Drive force transmission mechanism 31 may be configured to transmit drive force to shaft 88 of first feed roller 26 from drive shaft 29 via six gears. Drive force in the direction opposite to the rotating direction of drive shaft 29 may be transmitted to shaft 88 of first feed roller 26. In other words, shaft 88 may be rotated in the direction opposite to the rotating direction of drive shaft 29.

Drive force transmission mechanism 31 may comprise one-way clutch 90. One-way clutch 90 may be fitted into an inner hole of first feed roller 26. One-way clutch 90 may be configured to transmit drive force to first feed roller 26 when the drive force to feed a recording sheet in the sheet feeding direction, e.g., in the direction of arrow 43, is transmitted to shaft 88. One-way clutch 90 also may be configured to slip, e.g., to not transmit drive force to first feed roller 26, when the drive force to feed a recording sheet in a direction opposite to the sheet feeding direction is transmitted to shaft 88. When drive shaft 29 is rotated in the clockwise direction in FIG. 6, drive force in the counterclockwise direction transmitted to each shaft 88 from drive shaft 29 via gears may be interrupted with one-way clutches 90. Therefore, the drive force may not be transmitted to first feed rollers 26. At this time, as drive shaft 29 is rotated in the clockwise direction, first swing arms 28 supported pivotably by drive shaft 29 may be urged in a direction away from the bottom plate of lower sheet tray 13. Recording sheets in lower sheet tray 13 may be held in tray 13. When drive shaft 29 is rotated in the counterclockwise direction in FIG. 6, drive force in the clockwise direction transmitted to each shaft 88 from drive shaft 29 via gears may be transmitted to first feed rollers 26 with one-way clutches 90. At this time, as drive shaft 29 is rotated in the counterclockwise direction, first swing arms 28 supported rotatably by drive shaft 29 may be urged in a direction the bottom plate of lower sheet tray 13.

Each first swing arm 28 may be urged in a direction approaching the bottom plate of lower sheet tray 13 by its own weight, weights of corresponding first feed roller 26 and drive force transmission mechanism 31 and force of a spring (not shown). When the roller surfaces of first feed rollers 26 are brought into contact with a recording sheet in lower sheet tray 13, first swing arms 28 may stop. As drive force in the direction of feeding a recording sheet, e.g., the direction of arrow 43, is transmitted to first feed rollers 26 with first swing arms 28 stopped, friction force may be generated between the roller surface of each first feed roller 26 and a recording sheet, and the recording sheet may be fed in the sheet feeding direction. In an embodiment, first feed roller 26 may be positioned at each end of lower sheet tray 13 in its width, e.g., lateral, direction, such that sufficient feeding force may be applied to a recording sheet in lower sheet tray 13.

With sheet feeding mechanism 33 configured as described above, recording sheets held in upper sheet tray 12 or lower sheet tray 13 may be fed selectively with a drive control to switch a rotating direction of motor 71 in the clockwise or counterclockwise direction. In this embodiment, gears may be arranged in a direct path from drive shaft 29 to sheet trays 12, 13, such that drive force transmission mechanisms 30, 31 may be reduced in size. Because gears are not positioned above drive shaft 29, a recording device such as platen 48 and recording unit 24 may be positioned directly above drive shaft 29. Thus, MFD 1 may be reduced in thickness.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An image recording apparatus comprising:

a sheet supplying device configured to supply a sheet member, the sheet supplying device comprising:

a first tray and a second tray, each configured to hold at least one sheet member;

a first shaft and a second shaft, each extending over both of the first tray and the second tray, at least one first rotating member contacting the at least one sheet member held in the first tray;

a second rotating member contacting the at least one sheet member held in the second tray;

at least one first arm member extending from the first shaft to the at least one first rotating member;

a second arm member extending from the second shaft to the second rotating member; and a transmission device coupled to each of the first arm member and the second arm member and configured to transmit a rotational drive force in a first rotational direction to the at least one first rotating member and to transmit a rotational drive force in a second rotational direction to the second rotating member; and a recording unit configured to record an image on the sheet member supplied by the sheet supplying device, wherein the second tray further comprises at least one opening formed therethrough and the at least one first arm member extends through the opening in the second tray.

2. The image recording apparatus of claim 1, wherein the transmission device comprises:

a first transmission mechanism coupled to the at least one first arm member, and configured to transmit the rotational drive force moving in the first rotational direction from the first shaft to the at least one first rotating member;

a second transmission mechanism coupled to the second arm member, and configured to transmit the rotational drive force moving in the second rotational direction from the first shaft to the second shaft and from the second shaft to the second rotating member; and a clutch mechanism coupled to the first transmission mechanism and the second transmission mechanism, and configured to transmit selectively the rotational drive force to one of the at least one first rotating member and the second rotating member.

3. The image recording apparatus of claim 2, further comprising a first transmission gear and a second transmission gear, the first transmission gear and the second transmission gear being fitted to the first shaft and being separate from each other in an axial direction of the first shaft.

4. The image recording apparatus of claim 2, wherein the transmission device further comprises a transmission gear, which is affixed to and rotates with the first shaft and engages the second transmission mechanism.

5. The image recording apparatus of claim 2, wherein the clutch mechanism comprises:

a first one-way clutch configured to transmit the rotational drive force to the at least one first rotating member when the rotational drive force is moving in the first rotational direction; and a second one-way clutch configured to transmit the rotational drive force to the second rotating member when the rotational drive force is moving in the second rotational direction.

6. The image recording apparatus of claim 1, wherein the first tray comprises a first end and a second end opposite the first end in a lateral direction, and the at least one first rotating member is positioned at the first end and the second end.

7. The image recording apparatus of claim 6, wherein the second rotating member is positioned substantially at a middle portion of the second tray in the lateral direction.

8. The image recording apparatus of claim 7, wherein the at least one opening further comprises a first opening and a second opening formed through the second tray and the at least one first arm member comprises a pair of first arm members, one of which extends through the first opening and the other of which extends through the second opening in the second tray.

9. The image recording apparatus of claim 1, wherein the at least one first rotating member is supported pivotably by the first shaft, and the second rotating member is supported pivotably by the second shaft.

10. The image forming apparatus of claim 1, wherein each of the at least one first rotating member and the second rotating member is a roller.

11. The sheet supplying device according to claim 1, wherein the transmission device further comprises a transmission gear attached to the first shaft and an intermediate gear attached to the second shaft and engaged to the transmission gear, wherein the transmission gear transmits the rotational drive force via the intermediate gear to the second rotating member.

12. A sheet supplying device, comprising:

a first tray and a second tray, each configured to hold at least one sheet member;

a first shaft and a second shaft, each extending over both of the first tray and the second tray, a first rotating member contacting the at least one sheet member held in the first tray;

a second rotating member contacting the at least one sheet member held in the second tray;

a first arm member extending from the first shaft to the first rotating member;

a second arm member extending from the second shaft to the second rotating member; and a transmission device coupled to each of the first arm member and the second arm member and configured to transmit a rotational drive force in a first rotational direction to the first rotating member and to transmit a rotational drive force in a second rotational direction to the second rotating member, wherein the second tray further comprises an opening formed therethrough and the first arm member extends through the opening in the second tray.

13. The sheet supplying device of claim 12, wherein the transmission device comprises:

a first transmission mechanism coupled to the first arm member, and configured to transmit the rotational drive force moving the first shaft in the first rotational direction from the first shaft to the first rotating member;

a second transmission mechanism coupled to the second arm member, and configured to transmit the rotational drive force moving the first shaft in the second rotational direction from the first shaft to the second shaft and from the second shaft to the second rotating member; and a clutch mechanism coupled to the first transmission mechanism and the second transmission mechanism, and configured to transmit selectively the rotational drive force to one of the first rotating member and the second rotating member.

14. The sheet supplying device of claim 13, wherein the transmission device further comprises a transmission gear, which is affixed to and rotates with the first shaft and engages the second transmission mechanism.

15. The sheet supplying device of claim 13, wherein the clutch mechanism comprises:

a first one-way clutch configured to transmit the rotational drive force to the first rotating member when the rotational drive force is moving in the first rotational direction; and a second one-way clutch configured to transmit the rotational drive force to the second rotating member when the rotational drive force is moving in the second rotational direction.

16. The sheet supplying device of claim 12, wherein the first rotating member is supported pivotably by the first shaft, and the second rotating member is supported pivotably by the second shaft.

17. The sheet supplying device of claim 12, wherein the first tray comprises a first end and a second end opposite the first end in a lateral direction, and the first rotating member is positioned at the first end and the second end.

18. The sheet supplying device of claim 17, wherein the second rotating member is positioned substantially at a middle portion of the second tray in the lateral direction.

19. The sheet supplying device of claim 12, wherein each of the first rotating member and the second rotating member is a roller.

20. The sheet supplying device of claim 12, further comprising a first transmission gear and a second transmission gear, the first transmission gear and the second transmission gear being fitted to the first shaft and being separate from each other in an axial direction of the first shaft.

21. The sheet supplying device according to claim 12, wherein the transmission device further comprises a transmission gear attached to the first shaft and an intermediate gear attached to the second shaft and engaged to the transmission gear, wherein the transmission gear transmits the rotational drive force via the intermediate gear to the second rotating member.

22. A sheet supplying device comprising:

a first tray and a second tray, each configured to hold at least one sheet member;

a first shaft and a second shaft, each extending over both of the first tray and the second tray;

a pair of first rotating members each contacting the at least one sheet member held in the first tray;

a second rotating member contacting the at least one sheet member held in the second tray;

a pair of first arm members each extending from the first shaft to a corresponding one of the pair of first rotating members;

a second arm member extending from the second shaft to the second rotating member and disposed between the pair of the first arm members; and a transmission device coupled to each of the pair of the first arm members and the second arm member and configured to transmit selectively a rotational drive force from the first shaft to the pair of first rotating members or the second rotating member, wherein the second tray further comprises a first opening and a second opening formed therethrough and the pair of first arm members each extends through the first opening and the second opening.

23. The sheet supplying device according to claim 22 wherein the transmission device further comprises a transmission gear attached to the first shaft and an intermediate gear attached to the second shaft and engaged to the transmission gear, wherein the transmission gear transmits the rotational drive force via the intermediate gear to the second rotating member.

* * * * *